United States Patent [19]

Seto et al.

[11] Patent Number: 4,881,103

[45] Date of Patent: Nov. 14, 1989

[54] DEVELOPING APPARATUS

[75] Inventors: Yutaka Seto; Shigehiro Suzuki; Tomohiro Suzuki, all of Hachioji; Atsushi Fujita; Akira Tai, both of Kobe; Masahiro Yoshino, Hachioji, all of Japan

[73] Assignee: Konica Corporation, Tokyo, Japan

[21] Appl. No.: 114,867

[22] Filed: Oct. 30, 1987

[30] Foreign Application Priority Data

Oct. 31, 1986 [JP] Japan ..... 61-261442
Oct. 31, 1986 [JP] Japan ..... 61-168266[U]
Jun. 12, 1987 [JP] Japan ..... 62-146770

[51] Int. Cl.[4] ..... G03G 15/09; B05C 11/00

[52] U.S. Cl. ..... 355/251; 118/657; 118/688

[58] Field of Search ..... 355/3 DD, 14 D, 245, 355/251, 253, 259; 118/656–658, 688–694

[56] References Cited

U.S. PATENT DOCUMENTS 4,227,796 10/1980 Kamp et al. ..... 355/3 DD
4,324,199 4/1982 Morikawa ..... 355/3 DD X
4,373,468 2/1983 Suda et al. ..... 355/3 DD X
4,406,535 9/1983 Sakamoto et al. ..... 355/14 D X
4,406,536 9/1983 Suzuki et al. ..... 118/658 X
4,423,948 1/1984 Kimura et al. ..... 355/14 D
4,456,364 6/1984 Hatzis ..... 355/3 DD
4,711,551 12/1987 Fujio et al. ..... 355/3 DD

FOREIGN PATENT DOCUMENTS 0079374 5/1985 Japan ..... 355/3 DD

*Primary Examiner*—A. T. Grimley
*Assistant Examiner*—E. J. Pipala
*Attorney, Agent, or Firm*—Finnegan, Henderson, Farabow, Garrett and Dunner

[57] ABSTRACT

This invention discloses a developing apparatus wherein a brush of a developing agent is formed on a developing sleeve by a magnetic field of a permanent magnet disposed inside the developing sleeve, and at least the developing sleeve is rotated while the brush is kept in contact with a photosensitive body, thereby developing an electrostatic latent image formed on the photosensitive body. In this apparatus, an agitating member having magnetic ring portions which abut against the developing sleeve and an agitating portion for agitating the developing agent is pivotally disposed in a developing vessel to be parallel to the developing sleeve, and a rotation detecting unit for outputting a signal corresponding to a rotational speed of the agitating member and a residual amount detecting unit for detecting a residual amount of the developing agent in the developing vessel in accordance with an output from the rotation detecting unit are provided.

19 Claims, 4 Drawing Sheets

DEVELOPING APPARATUS

BACKGROUND OF THE INVENTION

1. Field of the Invention

The present invention relates to a magnetic brush type developing apparatus and, more particularly, to a cavity preventing structure and residual developing agent amount detection in the magnetic brush type developing apparatus.

2. Description of the Prior Art

Typical examples of a developing apparatus using a dry developing agent are a magnetic brush type and a cascade type. In a magnetic brush type developing apparatus, a developing agent brush is formed on a developing sleeve by a magnetic field of a permanent magnet disposed inside the developing sleeve, and at least one of the developing sleeve and the permanent magnet is rotated while the magnetic brush is kept in contact with a photosensitive body, thereby developing an electrostatic latent image formed on the phtosensitive body. Since the magnetic brush type developing apparatus can be made compact, it is used more widely than a cascade type developing apparatus. In this magnetic brush type developing apparatus, in order to form a magnetic brush on the developing sleeve, a developing agent must always be in good contact with the sleeve surface. For this purpose, a signal representing a residual amount of the developing agent must be output or formation of a cavity in the developing agent in a developing vessel must be prevented. Thus, a conventional developing apparatus comprises a residual developing agent amount detecting means or a developing agent agitating mechanism.

Examples of a conventional agitating mechanism are a mechanism in which an agitating member (e.g., a screw) is rotatably disposed in a developing vessel and is externally rotated and a mechanism in which a cantilevered vibrating plate is disposed in a developing vessel and is vibrated utilizing rotation of a developing roller (consisting of a permanent magnet and a developing sleeve).

However, when the former mechanism is used as an agitating mechanism, one end of the agitating member must be projected outside the developing vessel and rotated by a belt or the like. Therefore, a bearing and a loop unit for transmitting power must be provided to the apparatus, resulting in a complicated structure and a large size of the apparatus. In addition, a problem of toner leakage from the bearing is posed. Moreover, if a drive force is externally applied, a rotational speed is maintained constant regardless of an amount of a developing agent. Therefore, if the developing agent amount is large, an excessive stress acts on the developing agent, thereby degrading the developing characteristics of the apparatus. On the other hand, when the latter mechanism is used as an agitating mechanism, an agitating effect is small, and cavities are easily produced.

In addition, a conventional residual developing agent amount detecting means utilizes an amount or the like of a developing agent or uses a piezoelectric vibrator and a Hall element, resulting in a complicated arrangement.

SUMMARY OF THE INVENTION

The present invention has been made in consideration of the above situation and has as its object to provide a developing apparatus in which formation of cavities can be reliably prevented with a simple arrangement, a developing agent does not leak, and an excessive stress does not act on the developing agent, and to provide a developing apparatus capable of easily detecting a residual developing agent amount.

The present invention which eliminates the above problems is a developing apparatus wherein a brush of a developing agent is formed on a developing sleeve by a magnetic field of a permanent magnet disposed inside the developing sleeve, and at least the developing sleeve is rotated while the brush is kept in contact with a photosensitive body, thereby developing an electrostatic latent image formed on the photosensitive body, characterized in that an agitating member having magnetic ring portions which abut against the developing sleeve and an agitating portion for agitating the developing agent is pivotally disposed in a developing vessel to be parallel to the developing sleeve, and rotation detecting means for outputting a signal corresponding to a rotational speed of the agitating member and residual amount detecting means for detecting a residual amount of the developing agent in the developing vessel in accordance with an output from the rotation detecting means are provided.

In the developing apparatus according to the present invention, the ring portions of the agitating member are attracted by the permanent magnet and abut against the developing sleeve. Therefore, when the developing sleeve or the permanent magnet is rotated, the ring portions are rotated like a driven roller and the developing agent is agitated by the agitating portion of the agitating member, thereby preventing formation of cavities. In addition, a rotational speed of the agitating member is reduced when an amount of the developing agent is large and is increased as the developing agent is reduced. Therefore, the developing agent amount can be detected on the basis of a signal corresponding to the rotational speed.

DETAILED DESCRIPTION OF THE PREFERRED EMBODIMENT

An embodiment of the present invention will be described below with reference to the accompanying drawings.

Figure 1:
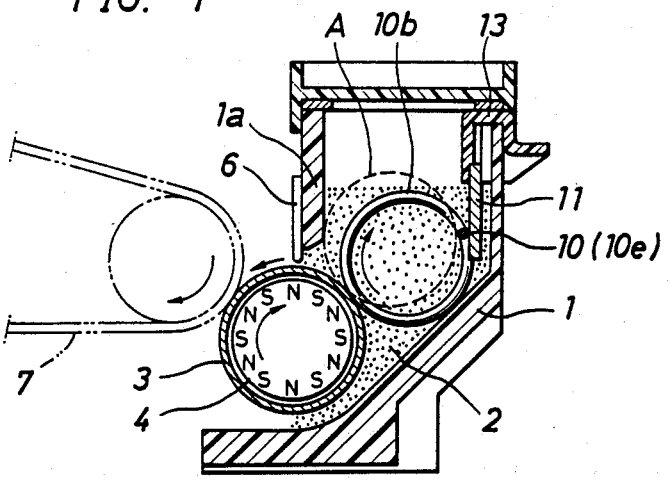
FIG. 1 is a sectional view of an arrangement of the main part according to an embodiment of the present invention.
Figure 2:
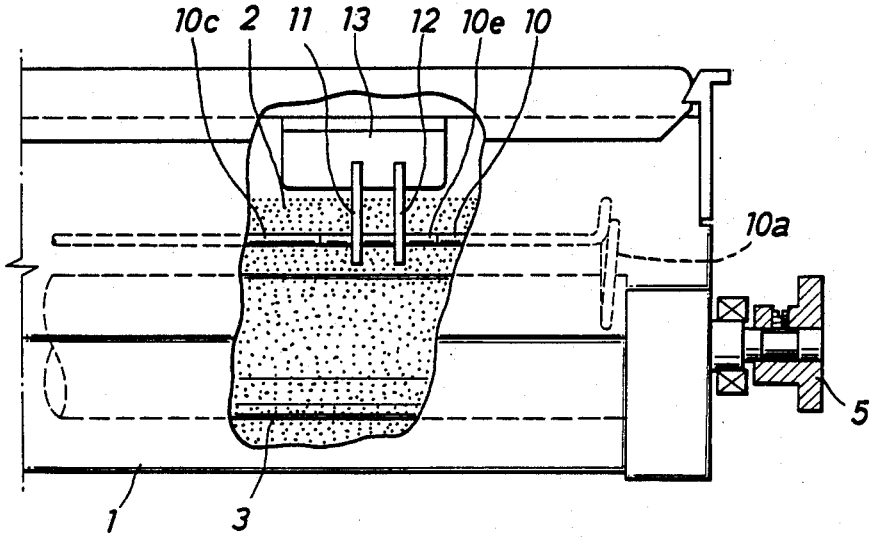
FIG. 2 is a side view of FIG. 1 viewed from the right side thereof.

FIG. 1 is a front view of an embodiment of the present invention showing an arrangement of the main part of a developing apparatus using one-component magnetic toner, and FIG. 2 is a partially cutaway side view of FIG. 1 viewed from the right side thereof. In FIGS. 1 and 2, reference numeral 1 denotes a developing vessel having toner 2 therein, and a developing sleeve 3 is disposed to be exposed from the developing vessel 1. The cylindrical developing sleeve 3 is made of a nonmagnetic material and rotated in a direction indicated by an arrow in FIG. 1 through a gear (not shown). A permanent magnet 4 obtained by alternately arranging magnetic poles N and S in the circumferential direction is rotatably supported inside the developing sleeve 3. The permanent magnet 4 is rotated in a direction indicated by an arrow in FIG. 1 through a gear 5 which is fitted on a projecting portion. Reference numeral 6 denotes a brush height regulating plate fixed to the developing vessel 1. A height of a toner brush formed on the developing sleeve 3 is determined in accordance with an interval between the distal end of the brush height regulating plate 6 and the developing sleeve 3. When the developing sleeve 3 and the permanent magnet 4 are rotated, the toner brush is brought into contact with a photosensitive body 7 which rotates in a direction indicated by an arrow in FIG. 1, thereby developing an electrostatic latent image formed on the photosensitive body 7.

Figure 3:
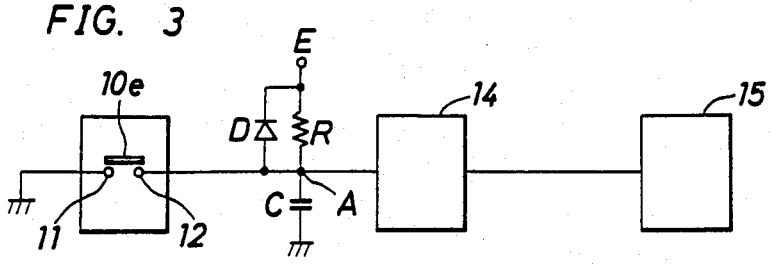
FIG. 3 is a circuit diagram of a residual developing agent amount detector.

Reference numeral 10 denotes an agitating member 10 including ring portions 10*a* and 10*b* each obtained by bending an end portion of a wire having a circular section to form a circle. The agitating member 10 is rotatably disposed in the toner 2 inside the developing vessel 1 so as to be aligned with the developing sleeve 3. At least the ring portions 10*a* and 10*b* of the agitating member 10 are made of a magnetic material and hence are attracted by the permanent magnet 4 to abut against the developing sleeve 3. The ring portions 10*a* and 10*b* are coaxially arranged by an intermediate portion 10*c* which connects rings thereof. An interval between the ring portions 10*a* and 10*b* is set slightly shorter than a length of the developing sleeve 3 so that the ring portions 10*a* and 10*b* abut against end portions of the developing sleeve 3 and set wider than an image width (effective image area) so that tracks of the ring portions 10*a* and 10*b* do not remain on the developing sleeve 3 to disturb development when an amount of the toner 2 becomes small. It is a matter of course that the ring portions 10*a* and 10*b* are located at positions where they can receive a sufficient magnetic attracting force from the permanent magnet 4. The intermediate portion 10*c* of the agitating member 10 is partially made of a conductive material to form a movable contact 10*e*. Note that movement of the agitating member 10 is regulated by the developing vessel 1 so that the agitating member 10 does not move axially relative to the developing sleeve 3. Reference numerals 11 and 12 denote fixed contacts disposed in the developing vessel 1 to abut against the movable contact 10*e* by an insulating base plate 13. The fixed contacts 11 and 12 are electrically connected with each other as shown in FIG. 3. That is, the fixed contact 11 is grounded, and the fixed contact 12 is connected to a positive power source E through a resistor R. Since a developing bias voltage is normally applied to the developing sleeve 3, the movable contact 10*e* must be insulated from the developing sleeve 3. A variety of insulating means can be made and any one of them may be used. For example, an insulating coating may be formed on a contact portion of the ring portions 10*a* and 10*b* which are brought into contact with the developing sleeve 3. Note that reference symbol D denotes a diode connected in parallel with the resistor R; and C, a capacitor connected between a node A between the fixed contact 12 and the resistor R and ground. This circuit prevents chattering. Reference numeral 14 denotes a retriggerable monostable multivibrator (to be referred to as simply a monostable multi hereinafter). The monostable multi 14 is triggered by a signal from the node A. An interval between output pulses from the monostable multi 14 is a signal corresponding to (inversely proportional to) a time interval from a timing at which the movable contact 10*e* is brought into contact with the fixed contacts 11 and 12 to a timing at which the movable contact 10*e* is separated therefrom, i.e., a rotational speed of the agitating member 4. Reference numeral 15 denotes a microprocessor for measuring the pulse interval between the output pulses from the monostable multi 14. When the pulse interval is reduced below a predetermined value, the microprocessor 15 outputs an alarm signal.

Figure 4:
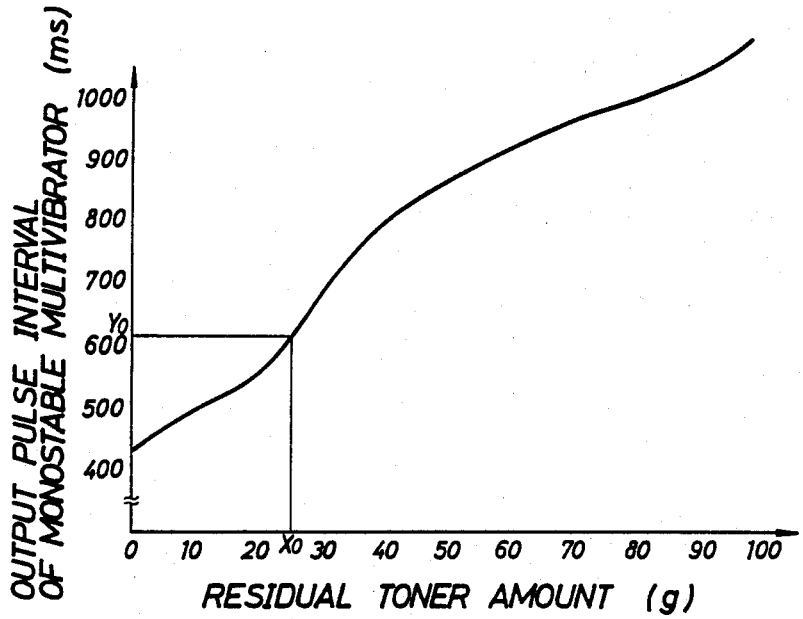
FIG. 4 is a graph of a relationship between a residual toner amount and an output pulse interval of a monostable multivibrator.

FIG. 4 shows a relationship between a residual toner amount and the output pulse interval of the monostable multi 14. As is apparent from FIG. 4, when the residual toner amount is reduced, the output pulse interval of the monostable multi 14 is also reduced. The microprocessor 15 utilizes this characteristic, i.e., detects that the residual toner amount reaches a residual toner amount Xo representing that replenishment of toner is needed when the output pulse interval of the monostable multi 14 becomes Yo.

An operation of the above embodiment will be described below. When the permanent magnet 4 and the photosensitive member 7 are rotated in the directions indicated by the arrows in FIG. 1, developing is performed. In this case, the ring portions 10*a* and 10*b* of the agitating member 10 are normally attracted to the permanent magnet 4 and abut against the developing sleeve 3. Therefore, when the developing sleeve 3 is rotated, the agitating member 10 starts to move in the rotating direction of the developing sleeve 3 as indicated by a broken line A in FIG. 1 by a frictional force produced between the ring portions 10*a* and 10*b* and the developing sleeve 3. However, movement of the agitating member 10 is limited by a wall 1*a* of the developing vessel 1, and the agitating member 10 is subjected to a force in the clockwise direction (an arrow direction) of FIG. 1 due to its weight and rotated in the same direction. The toner 2 at the upper portion of the developing vessel 1 is scraped by the intermediate portion 10*c* of the agitating member 10 and supplied toward the developing sleeve 3. In this embodiment, a diameter of the ring portions 10*a* and 10*b* is set such that a gap is formed between the agitating member 10 and the developing vessel 1. Although the agitating member 10 moves to a position indicated by the broken line A of FIG. 1, movement thereof changes irregularly in accordance with resistance of the toner. Therefore, the intermediate portion 10*c* does not move circularly on the same track but move circularly or elliptically on irregular tracks. For this reason, the intermediate portion 10*c* performs effective agitation and supplies the toner toward the developing sleeve 3. In addition, when the developing vessel 1 is filled with the toner 2 like immediately after replenishment of the toner 2, the agitating member 10 rotates slowly due to resistance of the toner 2. When the toner 2 is consumed and cavities tend to form, the rotational speed of the agitating member 10 is increased to perform sufficient agitation. Therefore, the agitating member 10 does not rotate unnecessarily to apply excessive stress to the toner 2.

When the residual toner amount reaches Xo, the output pulse interval of the monostable multi 14 becomes Yo, so that the microprocessor 15 outputs the alarm signal representing a need for toner replenishment.

In the above embodiment, a wire member having a circular cross section is used as the agitating member. However, the agitating member is not limited to such a wire member but may be a square rod, a pipe, or a plate member. In addition, the ring portions 10a and 10b are formed by winding a wire member having a circular cross section. However, the ring portions 10a and 10b may be formed by pressing a plate member and fixed at the intermediate portion 10c. The ring portions 10a and 10b need not be formed at both ends of the agitating member 10 but may be formed inside the both ends.

Figure 5:
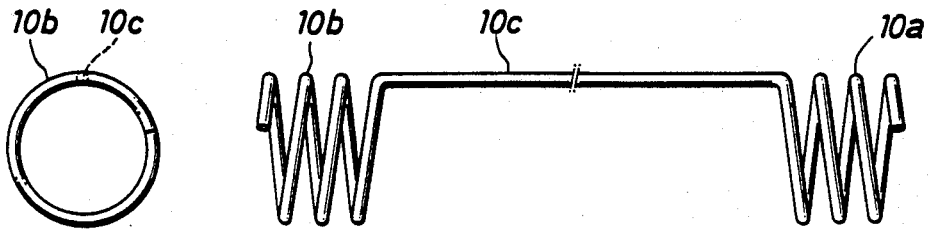
FIGS. 5 to 11 are front and side views, respectively, of other arrangements of an agitating member.
Figure 6:
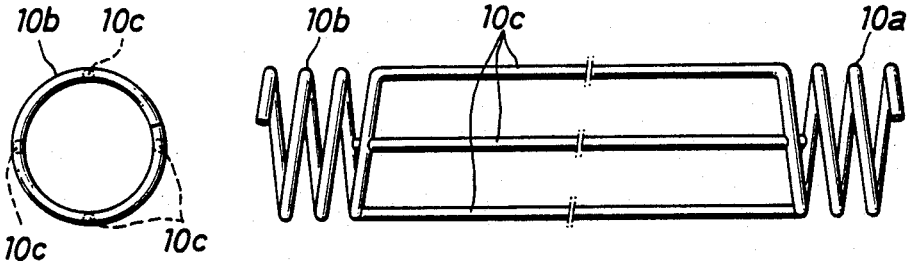
Figure 7:
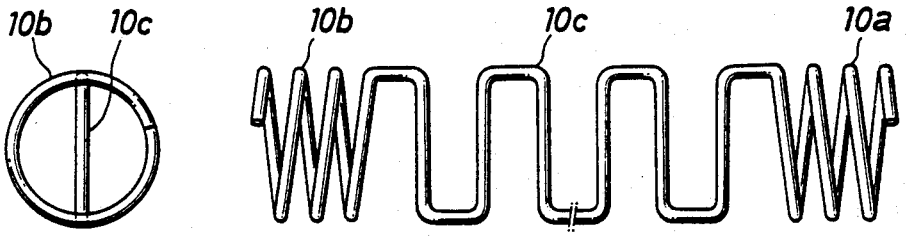
Figure 8:
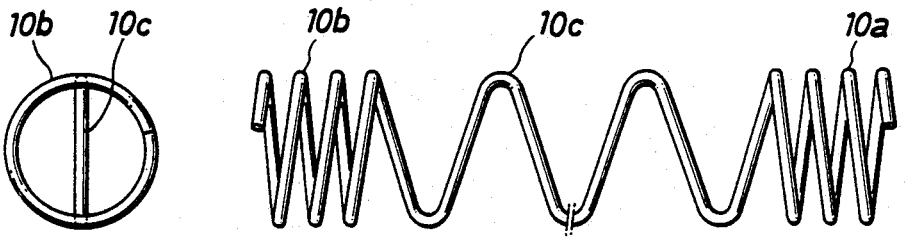
Figure 9:
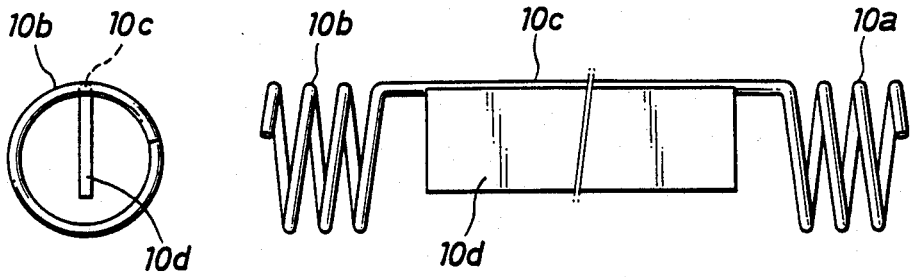
Figure 10:
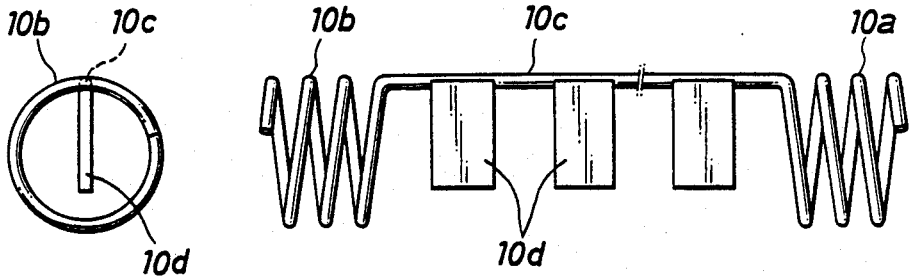

When a wire member is used as the agitating member, ends of the wire member may be wound spirally a plurality of times to form ring portions. FIG. 5 shows an agitating member thus formed in which end portions of the agitating member 10 are wound spirally a plurality of times to form ring portions 10a and 10b. In this case, the ring portions 10a and 10b are wound in directions opposite to each other. When such ring portions are used, the toner 2 is conveniently supplied toward the center upon rotation of the ring portions 10a and 10b.

Moreover, the intermediate portion 10c of the agitating member 10 need not be linear. By changing a shape (structure) of the intermediate portion 10c or the number of windings of the ring portions 10a and 10b, a relationship between the residual amount of the toner 2 and the rotational speed of the agitating member 10 can be arbitrarily changed. For example, when the number of windings of the ring portions 10a and 10b is increased, a rotational force (torque) applied to the ring portions 10a and 10b from the permanent magnet 4 is increased, thereby increasing the rotational speed thereof. Instead of increasing the number of windings, assume that a diameter of the ring portions 10a and 10b is increased or the ring portions 10a and 10b are formed to be cylindrical. In this case, however, the toner 2 enters between the ring portions 10a and 10b and the developing sleeve 3, and the ring portions 10a and 10b are separated from the permanent magnet 4, thereby reducing the rotational speed. This does not occur with the ring portions 10a and 10b having a winding shape or a shape similar thereto.

Figure 11:
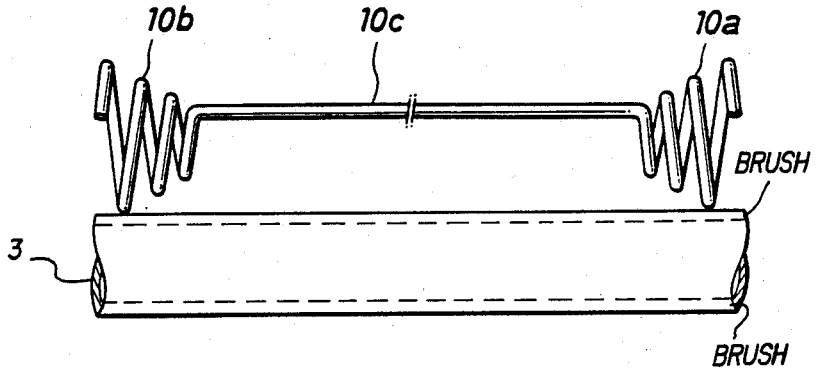

FIGS. 6 to 11 show shapes of the agitating member 10. In an arrangement shown in FIG. 6, a plurality of (four) linear intermediate portions 10c are provided to improve an agitating effect. In arrangements shown in FIGS. 7 and 8, the intermediate portions 10c are bent to have a rectangular wave shape and a sine wave shape, respectively. In an arrangement shown in FIG. 9, a single elongated agitating vane 10d is provided to the intermediate portion 10c, and in an arrangement shown in FIG. 10, a plurality of short agitating vanes 10d are provided thereto. In an arrangement shown in FIG. 11, a diameter of windings of the ring portions 10a and 10b is reduced toward the center of the intermediate portion 10c. The intermediate portion 10c is preferably separated from the developing sleeve 3 by a height of a brush or more so as not to adversely affect an image. On the other hand, the ring portions 10a and 10b must be, at least partially, in contact with the developing sleeve 3 and hence preferably fall outside the effective image area. As shown in FIG. 11, the agitating member 10 is disposed adjacent developing sleeve 3 such that ring portions 10a and 10b are in contact with developing sleeve 3. Therefore, if the winding diameter is reduced toward the center of the intermediate portion 10c, the ring portions 10a and 10b partially separated from the developing sleeve 3 by the height of the brush or more do not adversely affect the image even if they fall within the effective image area, thereby increasing the rotational speed. Thus, various shapes of the agitating member 10 may be adopted. Moreover, the ring portions 10a and 10b need not be formed by winding a wire member. For example, the ring portions 10a and 10b may be large-diameter screws.

In the above embodiment, the movable contact 10e is insulated from the developing sleeve 3. However, a single fixed contact may be provided, and the developing bias voltage may be received by an input terminal of a comparator, which is grounded through a resistor, through the movable contact 10e and the fixed contact. In this case, a voltage lower than the developing bias voltage is applied to the other input terminal of the comparator, and output pulses from the comparator are counted, thereby obtaining a signal corresponding to the rotational speed. In addition, the rotational speed of the agitating member 10 may be detected using an eddy current type proximity switch or a magnet in a noncontact state without using a contact switch.

For example, a magnet is fixed to the intermediate portion 10c, and a lead switch is disposed near a pivot track of the magnet, thereby detecting the rotational speed of the agitating member 10 in accordance with an ON/OFF operation of the lead switch using the detector shown in FIG. 3. That is, if a terminal of the lead switch is connected instead of the fixed contacts 11 and 12 of the detector shown in FIG. 3, the residual toner amount can be detected in accordance with the output pulse interval of the monostable multi 14 as described above. When the residual toner amount is reduced to the residual toner amount Xo which requires replenishment, the output pulse interval of the monostable multi 14 becomes Yo, and the alarm signal is output from the microprocessor 15. Note that if the agitating member, especially the intermediate portion thereof is formed to have a shape which receives large agitation resistance from the developing agent during agitation (e.g., an enlarged agitating vane if the agitating member has a vane), an inclination of the characteristic curve shown in FIG. 4 is increased. Therefore, in accordance with increase/decrease in the agitation resistance, accuracy of residual amount detection of the developing agent or an amount of stress acting on the developing agent can be adjusted.

Note that in the above embodiment, the developing sleeve 3 and the permanent magnet 4 are of a rotary type. However, the present invention can be applied to a developing apparatus in which only the developing sleeve 3 is rotated. In addition, the present invention can be applied to a developing apparatus in which a two-component developing agent is used.

As has been described above, according to the present invention, since the agitating member is reliably rotated, the developing agent is supplied well toward the developing sleeve, thereby realizing a developing apparatus in which no cavity is formed. In addition, the developing agent does not leak. Furthermore, when the developing vessel is filled with the developing agent like immediately after replenishment of the developing agent, the agitating member is rotated slowly due to resistance of the developing agent, and when the developing agent is consumed and cavities tend to form, the rotational speed of the agitating member is increased to perform sufficient agitation. Therefore, the agitating member does not unnecessarily rotate to apply excessive stress to the developing agent. Moreover, since the residual developing agent amount is detected utilizing rotation of the agitating member, residual amount detection can be performed with a simple arrangement.

What is claimed is:

1. A developing apparatus comprising:

a developing vessel for containing a developing agent;

a developing sleeve having an external surface, said developing sleeve being rotatable about an axis of rotation and being disposed relative to said developing vessel so that a a desired portion of said developing sleeve is disposed within said developing vessel;

a photosensitive body disposed adjacent said developing sleeve for developing an electrostatic latent image formed on said photosensitive body;

a permanent magnet disposed inside said developing sleeve for establishing a magnetic field to form a brush of developing agent adjacent said external surface of said developing sleeve, said developing sleeve being rotated while said brush is kept in contact with said photosensitive body;

an agitating member disposed in said developing vessel having at least two ring portions for providing frictional engagement with said external surface of said developing sleeve, so that said agitating member rotates as said developing sleeve rotates; and an agitating portion joining said at least two ring portions, said agitating portion being for agitating developing agent in said developing vessel.

2. An apparatus according to claim 1, wherein said agitating portion is separated from the surface of said developing sleeve by a height of the brush or more.

3. A developing apparatus as recited in claim 1, wherein said agitating portion has a predetermined size and shape for providing a predetermined relationship between volume of developing agent in said developing vessel and rotational velocity of said agitating member.

4. A developing apparatus as recited in claim 1, wherein said ring portions include a ferromagnetic material for providing magnetic attraction between said permanent magnet and said ring portions.

5. An apparatus according to claim 1, wherein said agitating member consists of a wire member, said ring portions are formed at both ends of said wire member by bending said wire member, and said agitating portion is formed at an intermediate portion of said wire member.

6. An apparatus according to claim 5, wherein said agitating portion consists of a plurality of wire members.

7. An apparatus according to claim 5, wherein said agitating portion is formed by bending the intermediate portion of said wire member to have a rectangular wave shape.

8. An apparatus according to claim 5, wherein said agitating portion is formed by bending the intermediate portion of said wire member to have a sine wave shape.

9. An apparatus according to claim 5, wherein said agitating portion is formed by providing an agitating vane at the intermediate portion of said wire member.

10. An apparatus according to claim 5, wherein said ring portions are formed by winding said wire member a plurality of times.

11. An apparatus according to claim 10, wherein a winding diameter of said ring portions is reduced toward the intermediate portion of said wire member.

12. A developing apparatus wherein a brush of a developing agent is formed on a developing sleeve by a magnetic field of a permanent magnet disposed inside said developing sleeve, and at least said developing sleeve is rotated while the brush is adjacent a photosensitive body, thereby developing an electrostatic latent image formed on said photosensitive body, characterized in that an agitating member having ring portions which abut against said developing sleeve and an agitating portion for agitating the developing agent is pivotally disposed in a developing vessel to be parallel to said developing sleeve, and rotation detecting means for outputting a signal corresponding to a rotational speed of said agitating member and residual amount detecting means for detecting a residual amount of the developing agent in said developing vessel in accordance with an output from said rotation detecting means are provided.

13. A developing apparatus as recited in claim 12, wherein said ring portions include a ferromagnetic material for providing magnetic attraction between said permanent magnet and said ring portions.

14. An apparatus according to claim 12 or 3 or 4, wherein said rotation detecting means comprises a magnet provided to said agitating portion of said agitating member, a lead switch disposed near a rotation track of said magnet and turned on/off in accordance with rotation of said magnet, and a pulse generator, triggered in accordance with ON/OFF of said lead switch, for generating a pulse corresponding to a rotational speed of said agitating member.

15. An apparatus according to claim 12 or 3 or 4, wherein said rotation detecting means comprises a movable contact provided to said agitating portion of said agitating member, fixed contacts provided in said developing vessel and opened/closed by said movable contact, and a pulse generator, triggered in accordance with opening/closing of said fixed contacts, for generating a pulse corresponding to a rotational speed of said agitating member.

16. A developing apparatus comprising:

a developing vessel containing a developing agent;

a developing sleeve having an external surface, said developing sleeve being rotatable about an axis of rotation and being disposed relative to said developing vessel so that a desired portion of said developing sleeve is disposed within said developing vessel;

a photosensitive body disposed adjacent said developing sleeve for developing an electrostatic latent image formed on said photosensitive body;

a permanent magnet disposed inside said developing sleeve for establishing a magnetic field to form a brush of said developing agent adjacent said external surface of said developing sleeve, said developing sleeve being rotated while said brush is kept in contact with said photosensitive body;

an agitating member disposed in said developing vessel having at least two ring portions for providing magnetic attraction to said permanent magnet and frictional engagement with said external surface of said developing sleeve and an agitating portion joining said at least two ferromagnetic ring portions, said agitating portion for agitating developing agent; and rotational speed detecting means for detecting the rotational speed of said agitating member and providing a speed signal in proportion thereto.

17. A developing apparatus as recited in claim 16, further including residual amount detecting means for detecting a residual amount of developing agent in said developing vessel in proportion to said speed signal from said rotational speed detecting means.

18. A developing apparatus as recited in claim 16, wherein said agitating portion has a predetermined size and shape to provide a predetermined relationship between volume of developing agent in said developing vessel and rotational velocity of said agitating member.

19. A developing apparatus as recited in claim 16, wherein said ring portions include a ferromagnetic material for providing magnetic attraction between said permanent magnet and said ring portions.

* * * * *